US005598957A

United States Patent [19]

Bell

[11] Patent Number: 5,598,957

[45] Date of Patent: Feb. 4, 1997

[54] ADJUSTABLE HANGER

[76] Inventor: David C. Bell, 168a Page Street, Middle Park, Victoria 3206, Australia

[21] Appl. No.: 395,241

[22] Filed: Jan. 13, 1995

Related U.S. Application Data

[63] Continuation-in-part of PCT/AU93/00350, published as WO Jul. 15, 1993.

[30] Foreign Application Priority Data

Jul. 16, 1992 [AU] Australia ..... PL3552

[51] Int. Cl.[6] ..... A47G 25/40; A47G 25/14

[52] U.S. Cl. ..... 223/94; 223/89; 223/85

[58] Field of Search ..... 223/85, 88, 89, 223/90, 91, 94, 93; D6/315, 324

[56] References Cited

U.S. PATENT DOCUMENTS

| | | | |
|---|---|---|---|
| 2,362,756 | 11/1944 | Kuss | 223/90 |
| 2,446,312 | 8/1948 | Usina | 223/89 |
| 2,496,561 | 2/1950 | Saunders | 223/94 |
| 2,513,980 | 7/1950 | Widmann | 223/89 |
| 2,556,530 | 6/1951 | Fichman | 223/90 |
| 2,629,525 | 2/1953 | Peterson | 223/89 |
| 2,817,471 | 12/1957 | Stoschy | 223/90 |
| 2,889,092 | 6/1959 | Gibron | 223/91 |
| 4,334,641 | 6/1982 | Narcum | 223/94 |
| 4,801,057 | 1/1989 | Heston | 223/92 |
| 4,854,489 | 8/1989 | Radcliffe | 223/95 |
| 4,895,283 | 1/1990 | Evangelist | 223/94 |
| 4,905,877 | 3/1990 | Gatling | 223/90 |
| 5,022,571 | 6/1991 | Blanchard | 223/95 |
| 5,044,535 | 9/1991 | Hunt | 223/95 |
| 5,085,358 | 2/1992 | Lam | 223/94 |

FOREIGN PATENT DOCUMENTS

| | | |
|---|---|---|
| 37230/84 | 10/1985 | Australia . |
| 2163891 | 7/1973 | France . |
| 2206783 | 1/1989 | United Kingdom . |
| 2208266 | 3/1989 | United Kingdom . |
| 9010408 | 9/1990 | WIPO . |
| 9011036 | 10/1990 | WIPO . |

*Primary Examiner*—Bibhu Mohanty
*Attorney, Agent, or Firm*—Oliff & Berridge

[57] ABSTRACT

An adjustable hanger has a hanger body, opposed carrying arms that are slidably extendable from the hanger body to increase or decrease the size of the hanger, and a connecting rod that is rotatable to cause the carrying arms to be extended or retracted from the hanger body. The connecting rod can be a hollow tube wherein the ends of the opposed carrying arms are inserted into the connecting rod and wherein oppositely wound spiral grooves on the inside of the connecting rod mate with projections on the ends of the carrying arms so that rotation of the connecting rod causes the carrying arms to be extended or retracted from the connecting rod. Alternately, oppositely wound spiral grooves formed on the outside of the carrying arms may mate with projections on the inside of the connecting rod so that rotation of the connecting rod causes the carrying arms to be extended or retracted from the connecting rod.

14 Claims, 2 Drawing Sheets

ADJUSTABLE HANGER

This is a Continuation-In-Part application of International Application PCT/AU93/00350 filed Jul. 15, 1993.

BACKGROUND OF THE INVENTION

1. Field of the Invention

This invention relates generally to an adjustable hanger, in particular an adjustable hanger that may be suspended for hanging clothes. Adjustable hangers are applicable for hanging articles of clothing such as coats, shirts, dresses and so on and it will be convenient to describe the invention with particular reference to that exemplary application. However, it is to be appreciated that the invention is not limited to that application.

2. Description of Related Art

Known hangers are used in a variety of applications. For example they facilitate the storage of clothing within wardrobes and can be used to hang and display clothing in retail shops. These hangers are available in a variety of constructions and sizes depending on the type and size of the article of clothing to be carried, as hangers of different sizes are generally necessary to support a clothing range of varying sizes.

It is seen to be advantageous to provide a hanger which is adjustable in size for facilitating the carriage of a variety of articles of clothing of different types and sizes.

A number of constructions have been proposed to facilitate adjustability in clothes hangers. For example, U.S. Pat. No. 4,334,641 discloses an adjustable hanger comprising four separate parts, with the width of the hanger being adjusted by sliding the parts relative to one another. Although this arrangement is quite simple, separate adjustment must be made for both sides of the hanger and a compromise must be achieved in the connection between the different parts, between allowing them to slide relative to one another and holding them securely once the width of the hanger has been set.

British Patent Application No. 2,208,266 discloses an adjustable garment hanger in which the adjustment is effected under a ratchet and pawl mechanism and U.S. Pat. No. 4,905,877 discloses an adjustment arrangement utilising a series of notches which are engageable by an extendible arm. In each case, the adjustment mechanism is complicated and involves adjustment of either side of the hanger to achieve symmetry. Further, as the adjustment is incremental, exact width adjustment of the hanger is not necessarily achievable.

SUMMARY OF THE INVENTION

It is an object of the present invention to provide an adjustable hanger which overcomes, or at least alleviates the above disadvantages.

With this in mind, the present invention provides an adjustable hanger including:

a hanger body, hanging means for suspending said hanger body, carrying means, and adjustment means, said carrying means and said hanger body cooperating to form a support surface for supporting articles and said carrying means including first and second oppositely located carry members which are adapted for movement relative to said hanger body, said adjustment means including an elongate connection member having a longitudinal axis and being adapted to connect said first and second carry members and whereupon rotation of said connection member about said longitudinal axis moves said first and second carry members in opposite directions.

This invention is described and defined herein with reference to the adjustable hanger suspended in a normal use orientation and terms such as "upwardly" and "downwardly" should be construed in the light of this orientation. However, it is to be appreciated that other orientations may be equally possible and that consequential changes in terms such as those above may be required in the light of those other orientations for a proper and complete understanding of the invention.

It will be convenient to further describe the invention by reference to the accompanying drawings which illustrate embodiments of the invention. Other embodiments of the invention are possible, and consequently the particularity of the accompanying drawings is not to be understood as superseding the generality of the preceding description of the invention.

DETAILED DESCRIPTION OF PREFERRED EMBODIMENTS

Figure 1:
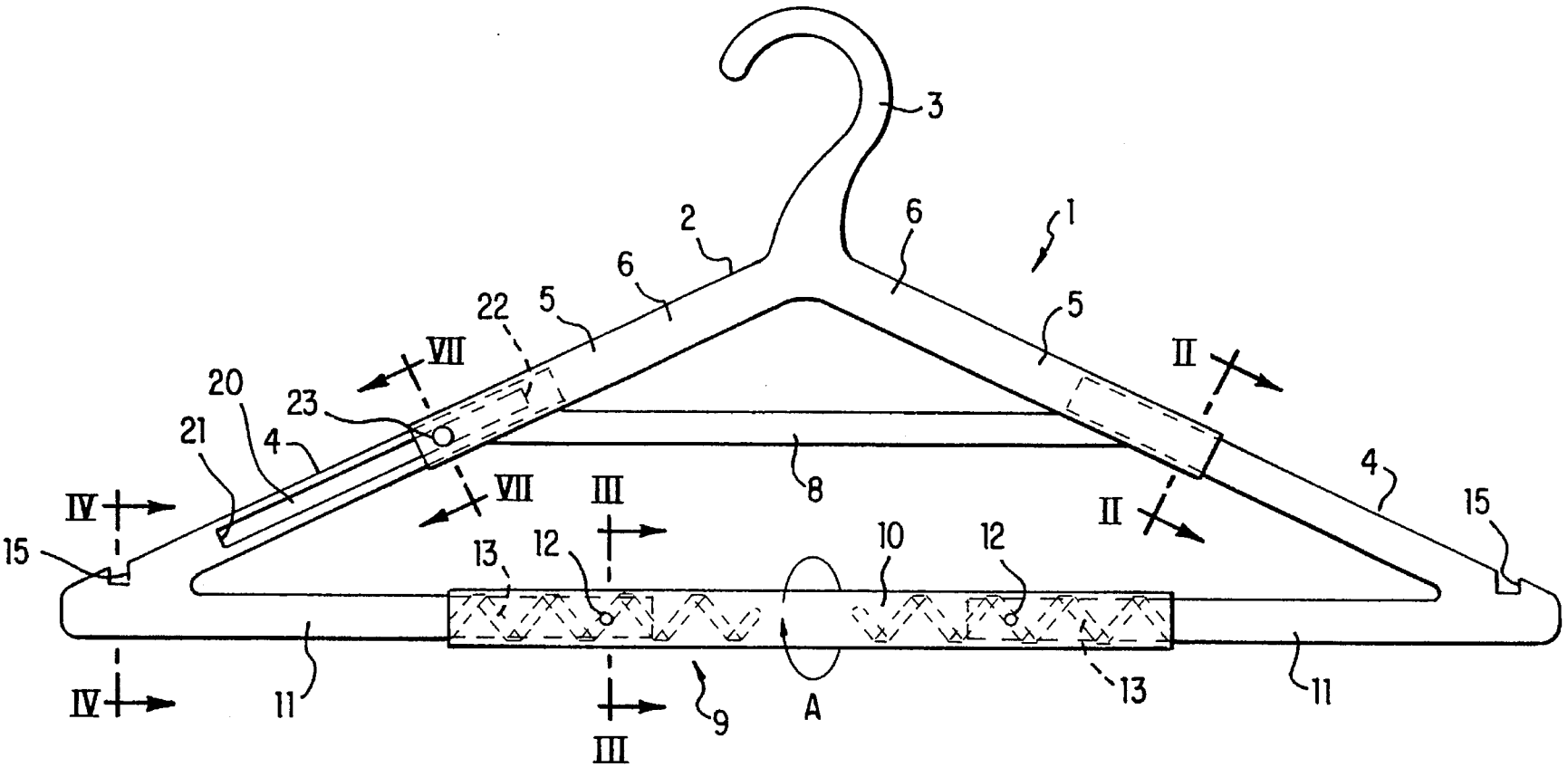
FIG. 1 is a front view of an adjustable hanger according to one embodiment of the invention.

The adjustable hanger shown in FIG. 1 includes a carry member 1 and a hanging means 3. The carry member 1 includes a main body 2 and carry arms 4 which extend from opposing sides of the main body 2. The hanging means 3 is shown in the form of a hook extending upwardly from the main body 2 to enable the adjustable hanger to be suspended from a hanging rail or other bearing means, however other forms of hanging means are clearly possible.

As previously noted, the adjustable hanger may be used to carry clothing and the illustrated embodiment has features making it particularly applicable for that purpose.

To this end, the carry member 1 may provide upper carrying surfaces 5 which may extend and incline downwardly from each side of the base of the hook 3. These inclined surfaces 5 may be provided by and extend substantially continuously from the main body 2 and along each of the carry arms 4. This is a similar configuration to known "coat hangers" in that the inclined surfaces 5 provide "shoulders" from which articles of clothing such as coats and shirts can be carried.

At least one of the carry arms 4 may be supported by the main body 2 such that it can be extended or retracted from the main body 2. Because the carry arms 4 extend at least substantially laterally from the main body 2, this enables the hanger to be adjusted to suit the size of the clothing to be supported. In the embodiment shown in FIG. 1, the extension of both carry arms 4 from the main body 2 may be adjusted.

Figure 2:
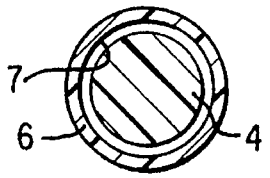
FIG. 2 is a cross-sectional view taken through section II—II of FIG. 1.

The main body 2 may include a pair of legs 6 extending from the base of the hook 3 and at an angle relative to each other. The legs 6 may be formed from hollow sections or may each have a bore 7 extending therethrough from the free end of each leg 6. The legs 6 may for example be formed from hollow tubular sections as shown in FIG. 2. Although this arrangement is only shown on the right side of the hanger in FIG. 1, this arrangement could, of course, be used on both sides of the hanger. As an alternative, the main body 2 may be formed as a solid triangular member having bores similar to the bores 7 shown. Each carry arm 4 may be slidably accommodated within the bores 7 of the legs 6.

At least a portion of the carry arm 4 accommodated within the bore 7 may have a circular cross section as shown in FIG. 2 which is a cross sectional view of the leg 6 and the carry arm 4 supported therein. To allow relative movement between the main body 2 and the carry arm 4, there may simply be sufficient clearance between the wall of the bore 7 and the carry arm 4 to allow the carry arm 4 to be slidably supported therein. In Figure 2, the clearance shown is exaggerated.

Alternatively, the carry arm 4 may be formed from a hollow section or may have a bore extending from the free end thereof such that the legs 6 may be slidably accommodated within the hollow section or bore of the carry arm 4.

A cross member 8 may extend between each of the legs 6 and may be joined to each leg 6 at or adjacent their free end. This cross member 8 may extend at least substantially horizontally when the clothing support is suspended. As well as reinforcing the legs 6, articles of clothing such as belts and ties may be hung from the cross member 8. It is envisaged that the hook 3, legs 6 and cross member 8 could be integrally formed using, for example, plastic moulding production methods.

Figure 3:
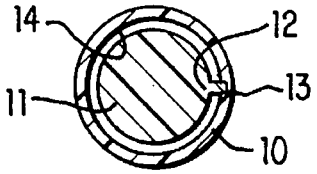
FIG. 3 is a cross-sectional view taken through section III—III of FIG. 1.
Figure 4:
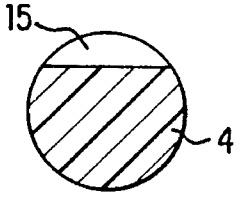
FIG. 4 is a cross-sectional view taken through section IV—IV of FIG. 1.

The carry arms 4 may be interconnected by an elongate connection means 9 extending between the carry arms 4. The connection means 9 may extend at least substantially horizontally when the adjustable hanger is suspended to facilitate the carrying of articles of clothing such as trousers. The adjustment means for adjusting the width of the adjustable hanger may be incorporated within the connection means 9 and may include a housing 10 and a rod 11 extending from each carry arm 4. The rod 11 may extend from the outer end of the carry arm 4 and may be integrally formed with the carry arm 4 as shown in FIG. 1. Each rod 11 may have a circular cross section and at least one pin 12 located preferably near the distal end of each rod 11. A spiral groove or thread 13 may be provided along the internal bore 14 of the housing 10 for engagement with each of the pins 12. With the carry arms 4 accommodated within their respective bores 7, the rods 11 as shown, are at least substantially aligned and directed towards each other. The housing 10 extends between the rods 11 and the bore 14 extends therethrough to accommodate the free ends of both rods 11 which are slidably accommodated within that housing 10. As shown in FIG. 3, which is a cross sectional view of the rod 11 accommodated within the housing 10, the housing 10 may be in the form of a hollow tubular section with clearance being provided between the wall of the bore 14 and the rod 11 to facilitate the sliding engagement therebetween.

Each of the pins 12 may extend from the outer surface of the rod 11 and into the spiral groove 13 provided on the wall of the bore 14. The spiral direction of the spiral groove 13 must be opposite at either end of the housing 10 and this change in direction, occurs preferably toward the middle of the housing 10. By rotating the housing 10 about its elongate axis, each pin 12 may run along its respective spiral groove 13 resulting in the extension or retraction of each of the rods 11 from the housing 10. Because of the opposing spiral directions of the spiral grooves 13 within the housing 10 the rods 11 can extend and retract in unison from the housing 10. Referring to FIG. 1, rotation of the housing 10 in a direction shown by arrow A extends the rods 11 which displaces the carry arms 4 laterally outwards and therefore increases the width of the hanger. Rotation of the housing 10 in the opposite direction causes the rods 11 to retract thereby decreasing the width of the hanger.

Alternatively, a spiral groove or thread may be formed on the outer surface of each rod 11, and a pin may extend from the wall of the bore 14 near each end of the housing 10, suitable to engage the spiral groove or thread. With this construction, the adjustment of the hanger would occur in much the same manner as already discussed, on rotation of the housing 10.

Figure 7:
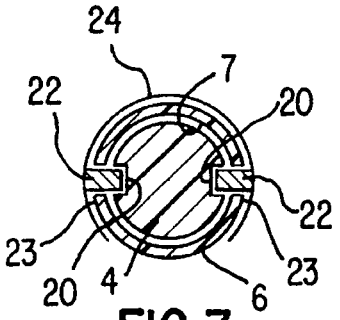
FIG. 7 is a cross-sectional view taken through Section VII—VII of FIG. 1.

To ensure that the carry arms 4 do not become fully removed from within the bores 7 during their outward lateral displacement, a groove 20 may be provided longitudinally along the length of each carry arm 4. This arrangement is illustrated in FIGS. 1 and 7. Although this arrangement is only shown on the left side of the hanger in FIG. 1, this arrangement could, of course, be used on both sides of the hanger. That groove 20 may have opposed abutment surfaces 21 located at each end thereof, such that a projection member 22 extending into the groove 20 will engage a respective abutment surface at a predetermined position of lateral extension or contraction of each carry arm 4.

With a projection member 22 extending inwardly from each of the legs 6 and into each groove 20, each carry arm 4 will be restricted to movement corresponding to movement of the projection members 22 within the grooves 20. Once the projection members 22 abut either of the abutment surfaces 21, no further movement in that direction of travel will be possible.

The projection members 22 may be provided in any suitable manner, but in the embodiment of FIG. 7, the projection members are fitted to a circlip 24 which extends about the periphery of each leg 6. The projection members 22 extend through openings 23 in the legs 6. While it is only necessary to provide one projection member 22, it is preferred that two projection members be provided and it is that arrangement which is illustrated.

In an alternative arrangement, the projection members 22 need not be fitted to a circlip, but instead may be fitted into the openings 23 and held by friction or adhesive or by any other suitable means.

The width of the hanger can therefore be quickly and easily adjusted to enable the proper support of articles of clothing of different types and sizes thereon.

Additional features may be added to the clothing hanger to improve its versatility. For example, a notch 15 can be provided at the upper carrying surface 5 at or adjacent the outer end of each carry arm 4 to facilitate support of, for example, skirts having hanging loops.

Figure 5:
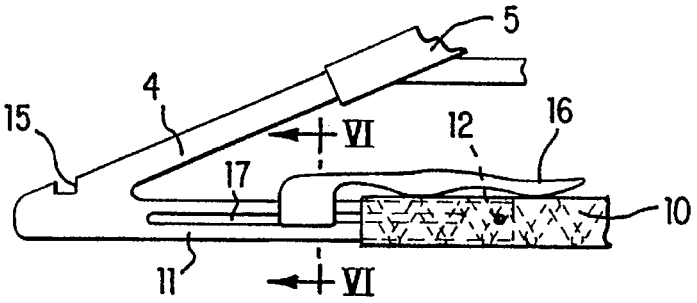
FIG. 5 is a cut-away view of one side of an adjustable hanger according to a further embodiment of the invention.
Figure 6:
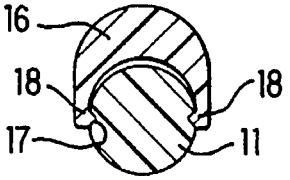
FIG. 6 is a cross-sectional view taken through section VI of FIG. 5.

Further it is envisaged that adjustable holding clips for holding trousers etc, be provided on each of the rods 11 and such a holding clip 16 is illustrated in FIGS. 5 and 6. To locate such holding clips, at least one groove 17 is formed on each of the rods 11 into which ends 18 of clips 16 are located. The clips 16 are fitted with an interference fit on the rods 11 to the extent that they may be moved along the rods 11, but will retain their position once set.

Various alterations, modifications and/or additions may be introduced into the constructions and arrangements of parts previously described without departing from the spirit or ambit of the invention.

I claim:

1. An adjustable hanger, comprising:

a hanger body, hanging means for suspending said hanger body, carrying means, and adjustment means, wherein said carrying means and said hanger body cooperate to provide a support surface for supporting articles of clothing, said carrying means including first and second carry members located on opposite sides of said hanger body, each said carry member having two legs, the first of said carry member legs having grooves extending longitudinally therealong and being in adjustable, telescopic engagement with said hanger body and the second of said carry member legs being in adjustable, telescopic engagement with said adjustment means, said adjustment means including an elongate connection member having a longitudinal axis which engages the second of said carry member legs of each said carry member on opposite sides thereof in said adjustable telescopic engagement, wherein rotation of said connection member about said longitudinal axis adjusts the position of the second of said carry member legs of each carry member relative to said connection member and wherein said rotation also results in adjustment of the relative position of the first of said carry member legs of each said carry member relative to the hanger body, so that the position of each of said carry members relative to said hanger body can be altered to increase or decrease the width of the adjustable hanger.

2. An adjustable hanger according to claim 1, wherein said connection member includes an internally threaded bore that is adapted to cooperate with engagement means on the second of said carry member legs.

3. An adjustable hanger according to claim 1, wherein said connection member includes two oppositely located left and right-hand internal threads, each internal thread being adapted to cooperate with engagement means on the second of said carry member legs.

4. An adjustable hanger according to claim 1, wherein said connection member includes an internal bore having engagement means, and wherein the second of said carry member legs include respective left and right-hand threads for cooperation with said engagement means.

5. An adjustable hanger according to claim 1 wherein said connection member is an elongate tubular member.

6. An adjustable hanger according to claim 2, wherein said engagement means includes a pin extending outwardly from the surface of the second of said carry member legs.

7. An adjustable hanger according to claim 1, wherein said connection member provides a substantially horizontal hanging surface when said hanger body is suspended.

8. An adjustable hanger according to claim 1, wherein the first of said carry member legs extend into bores located in said hanger body and are slidable therein.

9. An adjustable hanger according to claim 8, wherein said hanger body includes projection members slidable within said grooves on said first carry member legs and wherein said grooves include abutment surfaces at at least one end thereof so that upon movement of said projection members into engagement with said abutment surfaces, further movement in that direction is prevented.

10. An adjustable hanger according to claim 1, further including holding clips slidably located on at least one of said carry member legs.

11. An adjustable hanger according to claim 10, wherein a longitudinal groove is located on the outer at least one of said carry member legs, said holding clips engaging said grooves for correct positioning.

12. An adjustable hanger according to claim 11, wherein said holding clips are slidable along the length of each longitudinal groove.

13. An adjustable hanger according to claim 1, wherein said hanger body includes a cross member suitable for hanging articles.

14. An adjustable hanger according to claim 1 wherein the first of said carry member legs include locating notches to facilitate hanging of articles of clothing.

* * * * *